US010390597B2

(12) United States Patent
Chevalier et al.

(10) Patent No.: US 10,390,597 B2
(45) Date of Patent: Aug. 27, 2019

(54) DEVICE FOR APPLYING A COSMETIC COMPOSITION

(71) Applicant: L V M H RECHERCHE, Saint Jean de Braye (FR)

(72) Inventors: Marc Chevalier, Franconville (FR); Anne-Sophie Rattina, Orleans (FR); Myriam Chevalier, Boigny-sur-bionne (FR)

(73) Assignee: LVMH Recherche, Saint Jean de Braye (FR)

( * ) Notice: Subject to any disclaimer, the term of this patent is extended or adjusted under 35 U.S.C. 154(b) by 182 days.

(21) Appl. No.: 14/654,914

(22) PCT Filed: Nov. 21, 2013

(86) PCT No.: PCT/FR2013/052813

§ 371 (c)(1),
(2) Date: Jun. 23, 2015

(87) PCT Pub. No.: WO2014/102474

PCT Pub. Date: Jul. 3, 2014

(65) Prior Publication Data

US 2015/0351514 A1 Dec. 10, 2015

(30) Foreign Application Priority Data

Dec. 26, 2012 (FR) ..... 12 62806

(51) Int. Cl.
*A45D 40/26* (2006.01)
*A45D 2/48* (2006.01)

(52) U.S. Cl.
CPC ..... *A45D 2/48* (2013.01); *A45D 40/265* (2013.01)

(58) Field of Classification Search
CPC ..... A45D 34/042; A45D 34/043; A45D 34/045–34/047; A45D 40/262;
(Continued)

(56) References Cited

U.S. PATENT DOCUMENTS

2010/0095975 A1* 4/2010 Kim ..... A45D 40/265 132/217
2011/0297173 A1 12/2011 Anderson et al.
(Continued)

FOREIGN PATENT DOCUMENTS

JP H01-153115 6/1989
WO WO-92/11785 A1 7/1992
WO WO 2008/072585 A1 6/2008

OTHER PUBLICATIONS

French Preliminary Search Report for related French Application No. FR 1262806; report dated Sep. 11, 2013.
(Continued)

*Primary Examiner* — Rachel R Steitz
(74) *Attorney, Agent, or Firm* — Miller, Matthias & Hull LLP

(57) ABSTRACT

An application device for applying a cosmetic composition, comprising: a gripping element; a first head including a first surface; a rod connecting the gripping element and the first head and extending along the length of a longitudinal axis; and a second head mounted on the gripping element and comprising a second surface. The first and second heads are mounted such that they can move in relation to one another along the length of the longitudinal axis between an open position in which the first and second surfaces are at a distance from one another and a closed position in which the first and second surfaces are applied against one another. One of the first and second heads is an applicator head.

19 Claims, 4 Drawing Sheets

(58) Field of Classification Search
CPC .. A45D 40/264; A45D 40/265; A45D 40/267; A45D 40/268; A45D 2/48; A46B 5/0004; A46B 5/0012; A46B 5/005; A46B 5/007; A46B 5/0075; A46B 5/0083; A46B 9/021; A46B 2200/1053; A46B 2200/106
See application file for complete search history.

(56) References Cited

U.S. PATENT DOCUMENTS

| | | | | |
|---|---|---|---|---|
| 2011/0297174 | A1 | 12/2011 | Ornoski et al. | |
| 2014/0037360 | A1* | 2/2014 | Hofmann ..... | A45D 40/265 401/129 |

OTHER PUBLICATIONS

Japanese Office Action related to Application No. 2015-550128 dated Sep. 4, 2017.

* cited by examiner

DEVICE FOR APPLYING A COSMETIC COMPOSITION

CROSS-REFERENCE TO RELATED APPLICATIONS

This application is a 35 USC § 371 U.S. national stage filing of International Patent Application No. PCT/FR2013/052813 filed on Nov. 21, 2013, which claims priority under the Paris Convention and 35 USC § 119 to French Patent Application No. 12 62806, filed on Dec. 26, 2012.

FIELD OF THE DISCLOSURE

The present invention relates to a device for applying a cosmetic composition, comprising:

- a gripping element;
- a first head comprising a first surface;
- a rod connecting the gripping element and the first head and extending along a longitudinal axis; and
- a second head mounted on the gripping element and comprising a second surface.

BACKGROUND OF THE DISCLOSURE

Patent US2010/0095975 A1 discloses a device of this type, where the cosmetic composition is a mascara intended for application on the eyelashes of a user, while simultaneously clamping the eyelashes between first and second heads to curl them.

In that device, the first and second heads are hinged relative to one another on an axis perpendicular to the longitudinal axis and are biased away from one another by a spring between the two heads.

However, as the hinge axis and spring come in contact with the mascara, such a device tends to clog, making it difficult to apply the mascara and clamp the eyelashes, and in some cases prevents use of the device when the clogging is too significant.

In addition, the use of a spring to bias the two heads to an open position does not allow adjusting the aperture angle between the heads, and requires stop surfaces on each of the heads in order to limit this aperture angle.

Such a device therefore does not provide the user with optimum usability.

Also, still concerning the same device, each head is provided with a comb which combs the lashes while clamping them.

However, as the two heads must slide within a hollow sleeve, such a device is limited in terms of the functionalities that can be offered by the heads, particularly the functionalities of mascara loading and/or eyelash separation.

SUMMARY OF THE DISCLOSURE

The present invention aims to overcome these disadvantages by providing a device that simultaneously applies mascara and curls the lashes in an optimum manner and that is simple to use.

To this end, the invention relates to a device for applying a cosmetic composition of the aforementioned type, characterized in that the first and second heads are mounted such that they can move in relation to one another along the longitudinal axis between an open position in which the first and second surfaces are at a distance from one another and a closed position in which the first and second surfaces are applied against one another, and in that at least one of said first and second heads is an applicator head.

With these arrangements, it is not necessary to provide a hinge axis and spring, thereby limiting the clogging of the device.

Other advantages will be described below in connection with the description of various embodiments of the invention.

In preferred embodiments of the invention, one or more of the following arrangements may be used:

- the first and second heads are mounted such that they can move in relation to one another along the longitudinal axis only;
- the gripping element comprises a base and an open end opposite the base, the application device further comprising a sleeve extending along the longitudinal axis and having a first end attached to the open end of the gripping element and a free second end, the second head being attached to the free end of the sleeve;
- the rod lies at least partially inside the sleeve;
- the application device further comprises an actuator attached to the rod and mounted such that it can move in relation to the gripping element between a rest position in which the first and second heads are in the open position and an active position in which the first and second heads are in the closed position;
- the actuator is mounted such that it can move in relation to the gripping element along the longitudinal axis;
- the gripping element comprises a base and an opening formed in the base, the actuator extending through the opening on both sides of the base;
- the gripping element comprises a peripheral wall and two windows arranged in the peripheral wall and facing one another, the actuator extending through the two windows on both sides of the peripheral wall;
- the application device further comprises an elastic member adapted to bias the first and second heads toward the open position;
- the elastic member is arranged between the actuator and the sleeve;
- the gripping element comprises a base, the elastic member being arranged between the base and the rod;
- the application device further comprises an elastic member adapted to bias the first and second heads toward the closed position;
- the first and second surfaces each extend along an axis that is inclined relative to the longitudinal axis;
- the first and second surfaces have shapes that are complementary to each other;
- at least one of the first and second surfaces is provided with at least one accessory suitable for depositing an effective amount of cosmetic composition on the eyelashes of a user and/or for separating them;
- the first and second heads respectively comprise a third surface and a fourth surface, at least one of the third and fourth surfaces being provided with at least one accessory suitable for depositing an effective amount of cosmetic composition on the eyelashes of a user and/or for separating them;
- said accessory is selected from among a foam, a comb, a brush, a thread, and a flocking; and
- the application device further comprises an adjustment mechanism adapted to position the first and second heads in at least one stable intermediate position between the open position and the closed position, the first and second surfaces being at a distance from one another in said stable intermediate position.

The invention also relates to a system for the packaging and application of a cosmetic composition, comprising:

a container for containing the cosmetic composition; and an application device as described above, adapted to be mounted on the container, wherein the gripping element is adapted to seal the container closed and the rod is adapted to be inserted into the container when the gripping element is sealing the container closed.

In particular, the container contains mascara.

The invention further relates to a usage of a system as defined above, wherein the cosmetic composition is mascara and the mascara is applied to the eyelashes by means of the application device.

In particular, simultaneously with the application of mascara to the eyelashes, the eyelashes are clamped between the first and second heads.

BRIEF DESCRIPTION OF THE DRAWINGS

The invention will be better understood by reading the following description of various embodiments of the invention, given solely by way of example with reference to the accompanying drawings, in which.

The same references are used to denote identical or similar elements in the various figures.

DETAILED DESCRIPTION OF THE DISCLOSURE

Figure 1:
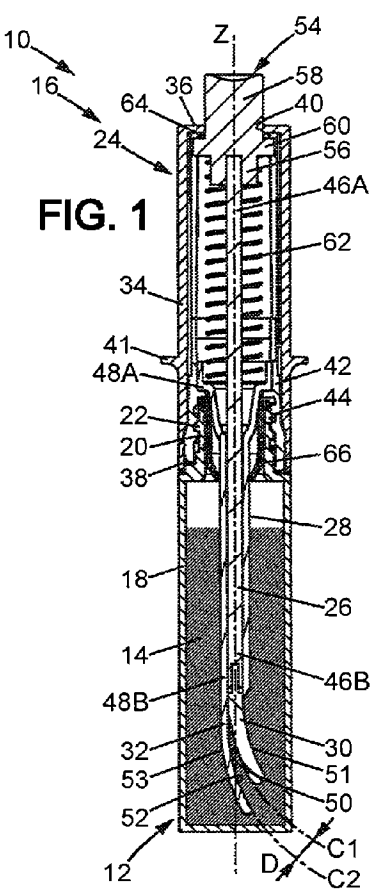
FIG. 1 is a longitudinal sectional view of a system for the packaging and application of a cosmetic composition according to a first embodiment of the invention, in an open position.

FIG. 1 illustrates a system 10 for the packaging and application of a cosmetic composition according to a first embodiment of the invention and in an open position, the cosmetic composition here being mascara intended for application on the eyelashes of a user.

The system 10 comprises a container 12 containing mascara 14 and an application device 16 mounted on the container 12.

The container 12 comprises a body 18 and a neck 20 extending as an extension of the body 18 while forming a shoulder relative to the body 18.

In the example concerned, the body 18 has a substantially cylindrical shape having a longitudinal axis Z and a substantially circular cross-section.

The neck 20, of substantially cylindrical shape having a longitudinal axis Z and a substantially circular cross-section, has an external thread 22.

The application device 16 comprises a gripping element 24, a rod 26, a sleeve 28, a first head 30, and a second head 32.

The gripping element 24 comprises a first portion 34 of substantially cylindrical shape having a longitudinal axis Z and a cross-section identical to that of the body 18 of the container 12.

The first portion 34 comprises a base 36 and an open end 38 opposite the base 36.

An opening 40 is formed in the base 36.

In the example described herein, the opening 40 has a substantially square shape.

Alternatively, the opening may be circular, rectangular, oval, etc.

The gripping element 24 further comprises a peripheral flange 41 which projects substantially radially outward from the first portion 34.

As will be described in more detail below, when the application device 16 is positioned in the user's hand, the peripheral flange 41 allows the user to actuate an actuator (described below) in a manner that clamps her lashes between the first and second heads 30, 32.

The gripping element 24 comprises a second portion 42 of substantially cylindrical shape having a longitudinal axis Z and a substantially circular cross-section.

The second portion 42 is secured inside the first portion 34, at the open end 38, forming a recess relative to the open end 38, this recess being complementary to the shoulder formed by the neck 20 and body 18 of the container 12.

The second portion 42 is provided with an internal thread 44 complementary to the external thread 22 of the neck 20, to enable screwing the gripping element 24 onto the neck 20 to seal the container 12 closed.

The gripping element 24 thus forms a cap for the container 12.

The second portion 42 facilitates assembly of the various parts of the application device 16 while reinforcing the general mechanical structure.

The second portion 42 also serves to improve the aesthetics of the system 10 by providing the internal thread 22 on this second portion 42 and not on the first portion 34 where this thread would be visible externally.

The rod 26 extends along the longitudinal axis Z between a proximal end 46A and a distal end 46B, and in the example described here has a substantially circular cross-section.

The rod 26 connects an actuator mounted on the base 36 of the gripping element 24, as will be explained in more detail below, and the first head 30.

The rod 26 is inserted into the container 12 when the gripping element 24 is sealing the container 12.

The sleeve 28 extends along the longitudinal axis Z and has an end 48A attached to the second portion 42 of the gripping element 24 and a free end 48B to which the second head 32 is attached.

The rod 26 lies at least partially inside the sleeve 28. Specifically, the rod 26 lies inside the sleeve 28 and protrudes longitudinally from end 48A of the sleeve 28 towards the base 36 of the gripping element 24. The first head 30 is attached to the distal end 46B of the rod 26 and is dipped into the mascara 14 when the gripping element 24 is sealing the container 12.

The first head 30 has a first inner surface 50 facing the second head 32 and a first outer surface 51 formed by the rest of the surface of the first head 30.

The first inner surface 50 is intended to clamp the eyelashes of the user when applied against a second inner surface of the second head 32, as will be described below.

Alternatively, in addition to its clamping functionality, the first inner surface 50 may also be provided with at least one accessory for applying mascara to the eyelashes 14 of the user and/or for separating the eyelashes.

The first outer surface 51 is not intended for clamping the eyelashes but it may provide the functions of mascara 14 application and/or eyelash separation.

In the embodiment described here, the entire surface of the first head 30 is covered with a spongy substance. The first head 30 will be referred to as the "applicator head 30" in the following.

Thus, the first inner surface 50 not only clamps the lashes but is also suitable for loading with mascara 14 in order to apply the mascara 14 on the lashes.

The first outer surface 51 does not provide the function of clamping the lashes but is suitable for loading with mascara 14 in order to apply it on the lashes.

Alternatively, the first inner surface 50 and/or the first outer surface 51 may be provided with at least one accessory such as a comb, a brush, a thread, a flocking, or more generally with raised and/or recessed elements forming a reservoir, these same elements also being used to separate the lashes, or any other accessory suitable for performing the functions of mascara application and/or eyelash separation.

In the embodiment described herein, the applicator head 30 has a substantially cylindrical shape, the first inner surface 50 extending along an axis C1 that is curved and inclined relative to the longitudinal axis Z.

The second head 32 is attached to the free end 48B of the sleeve 28 and is immersed in the mascara 14 when the gripping element 24 is sealing the container 12.

The second head 30 has a second inner surface 52 extending beneath and facing the first inner surface 50 of the applicator head 30, and a second outer surface 53 formed by the rest of the surface of the second head 32.

The second inner surface 52 is intended to clamp the eyelashes of the user when pressed against the first inner surface 50 of the applicator head 30.

Alternatively, in addition to its clamping function, the second inner surface 52 may also be provided with at least one accessory for applying mascara to the eyelashes 14 of the user and/or for separating the lashes.

The second outer surface 53 is not intended for clamping the lashes but it may provide the functions of mascara 14 application and/or eyelash separation.

In the embodiment described here, the opposing head 32 is integral with the sleeve 28 and the second inner 52 and outer 53 surfaces are substantially smooth. The second head 32 will be referred to as the "opposing head 32" in the following.

The second inner surface 52 is therefore only used to clamp the eyelashes while the second outer surface 53 lacks this function.

Alternatively, the second inner surface 52 and/or the second outer surface 53 may be provided with at least one accessory such as a foam, a comb, a brush, a thread, a flocking, or more generally with raised and/or recessed elements forming a reservoir, these same elements also being used to separate the lashes, or any other accessory suitable for performing the functions of mascara application and/or eyelash separation.

In the embodiment described herein, the second inner surface 52 extends along an axis C2 which is inclined and curved relative to the longitudinal axis Z.

The radius of curvature of the second inner surface 52 is substantially equal to the radius of curvature of the first inner surface 50.

In addition, the first inner surface 50 and the second inner surface 52 have substantially complementary cross-sections so that when they are applied against one another, the first and second inner surfaces 50, 52 are in contact with each other over substantially their entire surfaces.

Figure 3A:
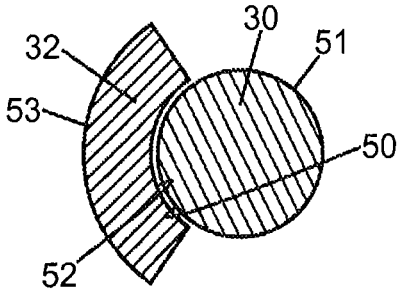
FIG. 3A is a sectional view along line III-III of FIG. 2.

Here, as represented in FIG. 3A, the first inner surface 50 and the second inner surface 52 have cross-sections substantially in the form of a circular arc that are respectively convex and concave and are complementary to one another.

Figure 3B:
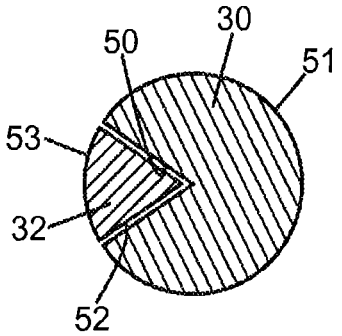
FIGS. 3B and 3C are views similar to that of FIG. 3A, illustrating variants of the head of the application device of FIG. 2.

In a first variant illustrated in FIG. 3B, the first inner surface 50 may have a cross-section in the shape of a "V" and the second inner surface 52 may have a cross-section in the form of an "inverted V" complementary to the V of the first inner surface 50. In this embodiment, the inverted V and V shapes could be adapted to the eyelash type, with a V and inverted V that are more or less wide and/or deep.

In a second variant, the first and second inner surfaces 50, 52 do not have complementary cross-sections but may have cross-sections such that, when the first and second inner surfaces 50, 52 are applied against one another, only a portion of their surfaces are mutually touching.

Figure 3C:
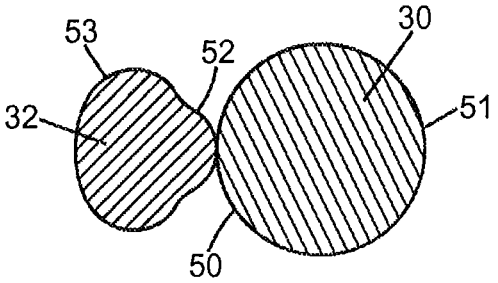

For example, as illustrated in FIG. 3C, the first and second inner surfaces 50, 52 may have a cross-section that is a substantially convex circular arc, the radius of curvature of the second inner surface 52 being smaller than that of the first inner surface 50. Here, the first and second inner surfaces 50, 52 are in contact with each other substantially along a line corresponding to the axes C1, C2.

Figure 2:
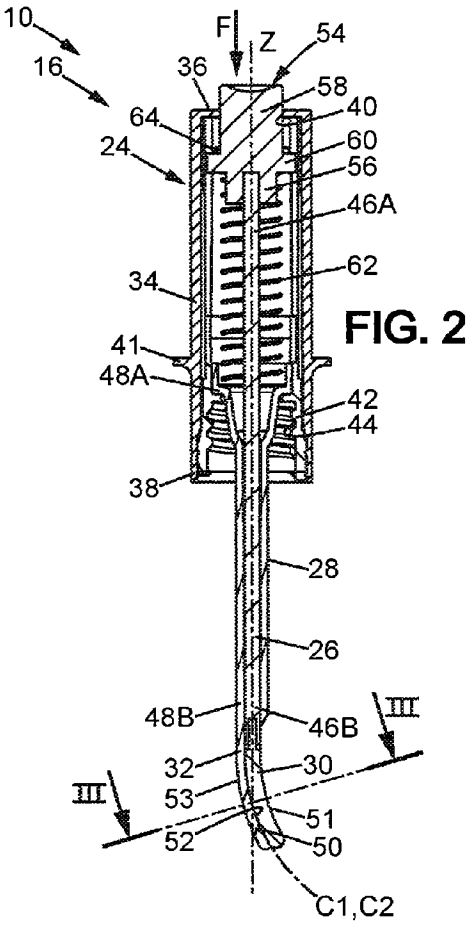
FIG. 2 is a longitudinal sectional view of an application device of the system of FIG. 1 in a closed position.

The applicator head 30 and the opposing head 32 are mounted such that they move in relation to one another along the longitudinal axis Z, and only along the longitudinal axis Z, between an open position where the first and second inner surfaces 50, 52 are apart from one another (FIG. 1) and a closed position where the first and second inner surfaces 50, 52 are pressing against one another (FIG. 2).

In the open position the axes C1, C2 are parallel, and in the closed position the axes C1 and C2 coincide.

In the open position, the axes C1, C2 are spaced apart by a distance D which corresponds to the open distance of the clamp formed by the two heads 30, 32, this open distance being related to the path traveled by one head relative to the other along the longitudinal axis Z, this path being itself related to the inclination of the heads 30, 32 relative to the longitudinal axis Z. For a given open distance, the more the heads 30, 32 are inclined relative to the longitudinal axis Z, the shorter the path traveled by one head relative to the other.

The application device 16 further comprises an actuator 54 adapted to move the applicator head 30 relative to the gripping element 24.

The actuator 54 is in the form of a substantially cylindrical pushbutton extending along the longitudinal axis Z.

The actuator 54 comprises an internal portion 56, an external portion 58, and an intermediate portion 60 connecting the internal and external portions 56, 58.

The internal portion 56 is attached to the proximal end 46A of the rod 26 and has a substantially circular cross-section.

The external portion 58 has a substantially square cross-section corresponding to the square shape of the opening 40 in the base 36 of the gripping element 24.

The external portion 58 extends through the opening 40 to both sides of the base 36.

The intermediate portion 60 has a substantially circular cross-section larger than the cross-section of the internal and external portions 56, 58 and corresponding to that of the first portion 34 of the gripping element 24.

The actuator 54 is mounted such that it can move in relation to the gripping element 24 along the longitudinal axis Z between a rest position in which the applicator head 30 and the opposing head 32 are in the open position (FIG. 1) and an active position in which the applicator head 30 and the opposing head 32 are in the closed position (FIG. 2).

The application device 16 further comprises an elastic member 62 adapted to bias the applicator head 30 and the opposing head 32 toward the open position, and thus to urge the actuator 54 toward the rest position.

The elastic member 62 extends along the longitudinal axis Z, inside the gripping element 24.

The elastic member 62 is in the form of a compression spring which has one end secured to the intermediate portion 60 of the actuator 54 and an opposite end secured to end 48A of the sleeve 28.

Alternatively, the elastic member may be a tension spring with one end secured to the base 36 of the gripping element 24 and an opposite end secured to the intermediate portion 60 of the actuator 54.

The application device 16 further comprises a sealing element 64 in the form of an annular seal arranged on the external portion 58 of the actuator 54, at its connection with the intermediate portion 60.

When the actuator 54 is in the rest position, the sealing element 64 is in contact with the base 36 of the gripping element 24 at the opening 40, thereby providing a seal between the exterior and the interior of the system 10, thus reducing the evaporation of solvent contained in the mascara 14 and therefore the drying of the mascara 14.

In addition, the system 10 comprises a wiper member 66 arranged inside the neck 20 of the container 12, intended for removing excess mascara 14 on the applicator head 30 and opposing head 32 prior to their withdrawal from the container 12. Such a wiper is well known and widely used in cosmetics. Based on the shape of the first and second heads 30, 32, and in particular their inclination to the longitudinal axis Z, "blade" wipers are preferably chosen.

The operation of the system 10 is explained below.

Initially, the system 10 is in the position illustrated in FIG. 1, where the gripping element 24 is screwed onto the neck 20 and caps the container 12 in a fluidtight manner.

The rod 26 provided with the applicator head 30 and the sleeve 28 provided with the opposing head 32 are immersed in the mascara 14.

The two heads 30, 32 are in the open position and the actuator 54 is in the rest position.

When a user wishes to apply mascara to her eyelashes 14 and curl her eyelashes, she grasps the gripping element 24 and unscrews it from the container 12.

When the gripping element 24 is completely unscrewed from the container 12, the user continues the movement of withdrawing the heads 30, 32 from the container 12 by moving the gripping element 24 along the longitudinal axis Z.

The passage of the applicator head 30 and opposing head 32 through the wiper member 66 removes the excess mascara 14 found on these heads.

Once the application device 16 is completely detached from the container 12, the user positions it in her hand so that the actuator 54 is in her palm and at least two fingers, for example the thumb and forefinger, are placed around the flange 41.

The user then positions the device 16 on her eyelashes such that the base of the lashes is inside the space between the applicator head 30 and the opposing head 32.

By pressing her palm against the actuator 54 as indicated by the arrow F in FIG. 2, the actuator 54 is moved to its active position, which simultaneously compresses the elastic member 62 and moves the applicator head 30 to the closed position.

The user's eyelashes are thus clamped between the first and second inner surfaces 50, 52.

While keeping the eyelashes clamped between the two heads, the user moves the device 16 from the base toward the tips of the eyelashes in a bottom-to-top and rolling motion that covers them with mascara 14 while curling them.

Once this operation is completed, the user releases the pressure of her palm on the actuator 54, which relaxes the elastic member 62 which then urges the actuator 54 toward the rest position and the two heads 30, 32 toward the open position.

Finally, the user inserts the heads 30, 32 into the container 12, if necessary with a slight pressure on the actuator 54 to facilitate insertion of said heads into the container 12, and screws the gripping element 24 onto the neck 20.

Before and/or after the eyelash clamping operation, the user may make further use of various additional features offered by the heads 30, 32.

Here, due to the mascara application functionality of the first outer surface 51 of the applicator head 30, the user can cover her eyelashes with mascara 14 by applying the first outer surface 51 to her eyelashes before and/or after said clamping.

If the second outer surface 53 of the opposing head 32 comprises a comb, the user could apply this surface to her lashes to comb them before and/or after said clamping, before and/or after coating them by means of the first outer surface 51.

Figure 4:
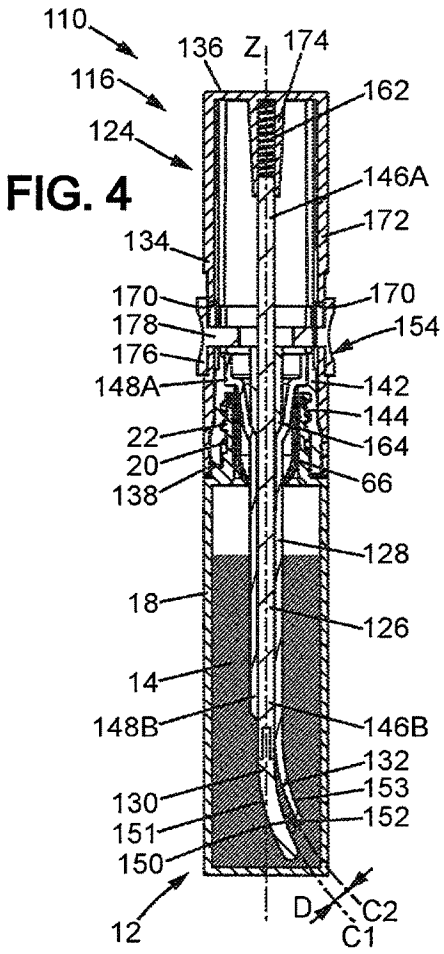
FIG. 4 is a longitudinal sectional view of a system for the packaging and application of a cosmetic composition according to a second embodiment of the invention, in an open position.

FIG. 4 illustrates a system 110 for the packaging and application of a cosmetic composition according to a second embodiment of the invention.

This second embodiment of the invention, which is similar to the first embodiment, will not be described again in detail here. It differs from the first embodiment of FIGS. 1 and 2 in that the first portion 134 of the gripping element 124 does not comprise an opening in the base 136 but comprises two opposing windows 170 formed in a central section of its peripheral wall 172 which are opposite one another.

In the example described here, the windows 170 have a rectangular shape.

The first portion 134 further comprises a socket 174 which projects from the base 136 to inside the first portion 134, along the longitudinal axis Z.

The gripping element 124 does not comprise a peripheral flange.

The proximal end 146A of the rod 126 is inserted into the socket 174.

The second inner surface 152 of the opposing head 130 lies above and facing the first inner surface 150 of the applicator head 130.

This arrangement of the two heads relative to each other limits smearing on the eyelid of the wearer during application of the mascara 14, and allows concurrent curling of the eyelashes.

The actuator 154 comprises a peripheral ring 176 and a center pin 178 fixed to the ring 176 and extending along a diameter of the ring 176.

The ring 176 surrounds the peripheral wall 172 of the gripping element 124 and has a curved longitudinal profile suitable for receiving the fingertips of a user's hand.

The pin 178 extends through the windows 170 and is substantially fixed to a central section of the rod 126.

Alternatively, the peripheral ring 176 may be replaced by two opposing sliders fixed to the two opposite ends of the pin 178.

The elastic member 162 is a compression spring extending between the base 136 and the proximal end 146A of the rod 126, inside the socket 174.

Alternatively, the elastic member is a tension spring having one end secured to the fixed end 148A of the sleeve 128 and an opposite end secured to the pin 178 of the actuator 154.

The sealing element 164 has an elongated shape and is arranged around the rod 126, inside end 148A of the sleeve 128 and attached to the sleeve 128.

Alternatively, the sealing element 164 may be attached to the rod 126.

The sealing element 164 is in contact with the actuator 154 when the actuator 154 is in the rest position.

The operation of the system 110 is explained below.

Initially, the system 110 is in the position illustrated in FIG. 4, where the gripping element 124 is screwed onto the neck 20 and seals the container 12 closed.

The rod 126 provided with the applicator head 130 and the sleeve 128 provided with the opposing head 132 are immersed in the mascara 14.

The two heads 130, 132 are in the open position and the actuator 154 is in the rest position.

When a user wishes to apply mascara to her eyelashes 14 and curl her eyelashes, she grasps the gripping element 124 and positions it in her hand so that the base 136 of the gripping element 124 is in her palm and at least two fingers, for example the thumb and index finger, are placed on the ring 176 of the actuator 154.

Figure 5:
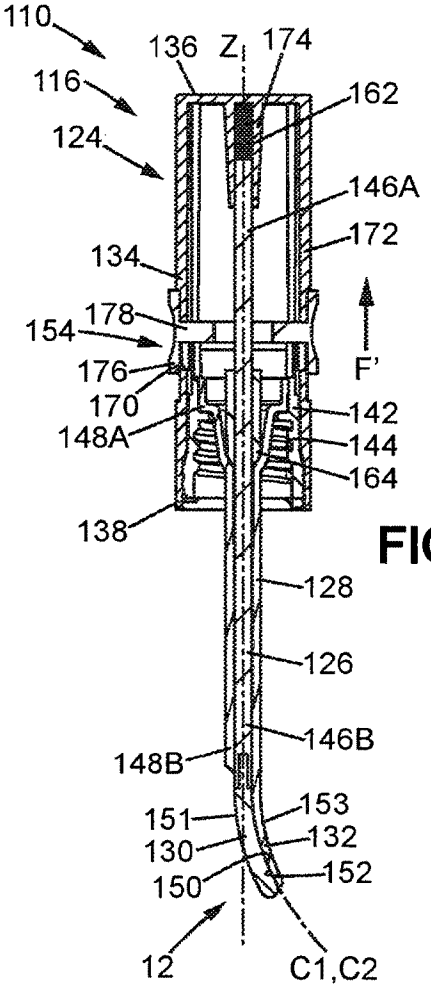
FIG. 5 is a longitudinal sectional view of an application device of the system of FIG. 4 in a closed position.

The user then places the device 116 on her lashes such that the base of lashes is inside the space between the applicator head 130 and the opposing head 132. By moving the ring 176 toward her palm using her two fingers as indicated by the arrow F' in FIG. 5, the actuator 154 is moved to its active position, which simultaneously compresses the elastic member 162 and moves the applicator head 130 to the closed position.

The user's eyelashes are then clamped between the first inner surface 150 and the second inner surface 152.

While keeping the eyelashes clamped between the two heads, the user moves the device 116 from the base toward the tips of the eyelashes in a bottom-to-top and rolling motion that covers them with mascara 14 while curling them.

Once the above operation is completed, the user releases the pressure exerted by her two fingers on the actuator 154, which relaxes the elastic member 162 which then urges the actuator 154 toward the rest position and the two heads 130, 132 toward the open position.

The invention thus proposes a system for the packaging and application of a cosmetic composition for eyelashes or hair which allows applying the cosmetic composition while clamping them in order to curl them and give them the desired shape, which is simple to use and in which the risk of clogging is reduced.

When the applicator head and/or opposing head is equipped with additional accessories such as a foam, a comb, a brush, etc., the invention further provides the user with additional cosmetic and treatment functions for eyelashes.

Thus, given the many functions that each of the heads can provide, independently or combined, these heads are interchangeable, with the applicator head being the opposing head and vice versa, the only requirement being that they have respective inner surfaces adapted to cooperate with each other in order to clamp the eyelashes.

In practice, it is possible to arrange the heads to implement known technologies. For example, for a head according to the invention it is possible to use a brush having a twisted wire and bristles extending radially, an injected head comprising teeth that extend radially to form a comb, an injected rigid core comprising a surface with raised and/or recessed areas, or a head combining the two technologies, such as an one-piece injected head comprising means for attaching a head comprising a twisted wire. Flocked or foam heads are also widely known, as is the more general use of a flocking or a cellular foam-type structure for applying a cosmetic product.

Each of these well-known techniques can be implemented to create an accessory of a head in the meaning of the invention.

In a variant of the embodiments described above, the first and second inner surfaces of the heads may extend respectively along a first and a second axis not inclined and curved relative to the longitudinal axis but inclined and straight relative to the longitudinal axis.

In another variant of the embodiments described above, the elastic member may be adapted to bias the heads into the closed position. For example, it is sufficient to reverse the arrangement of the heads relative to each other between the first and second embodiments.

More specifically, in the first embodiment, the arrangement of the heads is that of the second embodiment, meaning that the applicator head is arranged below the opposing head and is pressed against the opposing head (closed position of the heads of FIG. 5) in the rest position of the actuator of FIG. 1. By pressing the actuator (FIG. 2), the heads would be placed in the open position illustrated in FIG. 4.

Conversely, in the second embodiment, the arrangement of the heads would be that of the first embodiment, meaning that the opposing head would be arranged below the applicator head and pressed against the applicator head (closed position of the heads in FIG. 2) in the rest position of the actuator of FIG. 4. By actuating the actuator (FIG. 5), the heads would be placed in the open position illustrated in FIG. 1.

In yet another alternative to the embodiments described above, a mechanism for adjusting the opening of the clamp formed by the heads may be provided to improve ease of use when the user utilizes the system.

This adjustment mechanism is adapted to position the heads in at least one stable intermediate position between the open position and the closed position, the first and second inner surfaces being apart from one another in this stable intermediate position.

"Stable position" is understood to mean that the heads remain in that position in the absence of external force to the system, particularly in the absence of force exerted by the user on the actuator.

Figure 6:
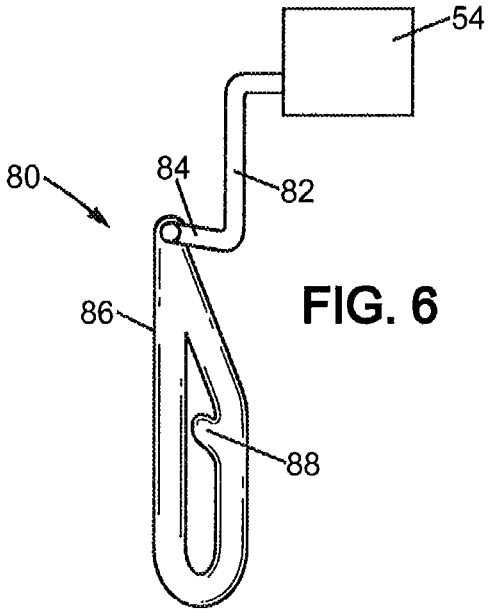
FIGS. 6 and 7 are schematic views illustrating variants of an adjustment mechanism of the system of FIG. 1.

For example, as illustrated in FIG. 6, the adjustment mechanism 80 comprises a resilient tab 82 integral with the actuator 54 and which at rest extends substantially axially inside the gripping element.

The adjustment mechanism 80 further comprises a pin 84 projecting radially from the free end of the tab 82.

The adjustment mechanism 80 further comprises a track 86 formed on the inner wall of the first portion of the gripping element and adapted to receive the pin 84.

The track 86 is provided with at least one retaining point 88 formed by a securing notch that retains the pin in a position of the actuator corresponding to the intermediate position of the heads.

Figure 7:
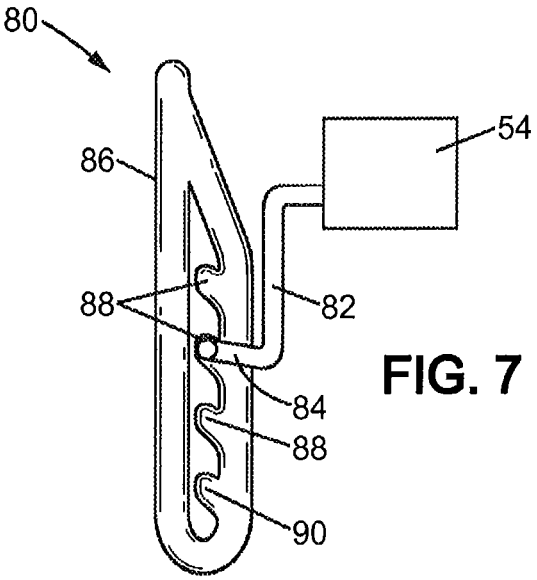

Of course, it is possible to provide a plurality of stable intermediate positions and therefore as many retaining points 88 on the track 86, for example three retaining points 88 in FIG. 7.

In the first and second embodiments described above, the closed position of the heads is an unstable position. The adjustment mechanism described above can be adapted to stabilize the closed position by providing a corresponding retaining point 90 on the track 86.

Such an adjustment mechanism would eliminate the user having to exert force continuously on the actuator while applying makeup and shaping her eyelashes, thereby providing optimum comfort when using the system.

The invention claimed is:

1. A system for the packaging and application of a cosmetic composition, comprising:

a container for containing the cosmetic composition; and an application device for the cosmetic composition, adapted to be mounted on the container, the application device comprising:

a gripping element adapted to seal the container closed;

a first head comprising a first surface;

a rod connecting the gripping element and the first head, the rod extending along a longitudinal axis and being adapted to be inserted into the container when the gripping element is sealing the container closed; and a second head mounted on the gripping element and having a second surface wherein the first and second heads are mounted such that they can move in relation to one another along the longitudinal axis between an open position in which the first and second surfaces are at a distance from one another and a closed position in which the first and second surfaces are applied against one another so as to clamp the eyelashes of a user and to apply some of said cosmetic composition onto said eyelashes, and wherein at least one of said first and second heads is an applicator head, wherein at least one of the first and second surfaces is provided with at least one accessory suitable for depositing an effective amount of cosmetic composition on the eyelashes of a user and/or for separating them, and wherein said accessory is selected from among a foam, a comb, a brush, a thread, and a flocking.

2. The system according to claim 1, wherein the first and second heads are mounted such that they can move in relation to one another along the longitudinal axis only.

3. The system according to claim 1, wherein the gripping element comprises a base and an open end opposite the base, the application device further comprising a sleeve extending along the longitudinal axis and having a first end attached to the open end of the gripping element and a free second end, the second head being attached to the free end of the sleeve.

4. The system according, to claim 3, wherein the rod lies at least partially inside the sleeve.

5. The system according to claim 1, further comprising an actuator attached to the rod and mounted such that it can move in relation to the gripping element between a rest position in which the first and second heads are in the open position and an active position in which the first and second heads are in the closed position.

6. The system according to claim 5, wherein the actuator is mounted such that it can move in relation to the gripping element along the longitudinal axis.

7. The system according to claim 5, wherein the gripping element comprises a base and an opening formed in the base, the actuator extending through the opening on both sides of the base.

8. The system according to claim 5, wherein the gripping element comprises a peripheral wall and two windows arranged in the peripheral wall and facing one another, the actuator extending through the two windows on both sides of the peripheral wall.

9. The system according to claim 1, further comprising an elastic member adapted to bias the first and second heads toward the open position.

10. The system according to claim 9 together with claims 3 and 5, wherein the elastic member is arranged between the actuator and the sleeve.

11. The system according to claim 9, wherein the gripping element comprises a base, the elastic member being arranged between the base and the rod.

12. The system according to claim 1, further comprising an elastic member adapted to bias the first and second heads toward the closed position.

13. The system according to claim 1, wherein the first and second surfaces each extend along an axis that is inclined relative to the longitudinal axis.

14. The system according to claim 1, wherein the first and second surfaces have shapes that are complementary to each other.

15. The system according to claim 1, wherein the first and second heads respectively comprise a third surface and a fourth surface, at least one of the third and fourth surfaces being provided with at least one accessory suitable for depositing an effective amount of cosmetic composition on the eyelashes of a user and/or for separating them.

16. The system according to claim 1, further comprising an adjustment mechanism adapted to position the first and second heads in at least one stable intermediate position between the open position and the closed position, the first and second surfaces being at a distance from one another in said stable intermediate position.

17. The system according to claim 1, wherein the container contains a mascara.

18. A usage of the system according to claim 1, wherein the cosmetic composition is mascara, wherein said usage comprises an application step consisting in applying the mascara to the eyelashes by means of the application device.

19. The usage according to claim 18, wherein said usage comprises a clamping step consisting in clamping the eyelashes between said first and second heads, said clamping step being simultaneous with said application step.

* * * * *